US007206506B2

(12) United States Patent
Sturm

(10) Patent No.: US 7,206,506 B2
(45) Date of Patent: Apr. 17, 2007

(54) FLUID HEATING SYSTEM

(75) Inventor: William R. Sturm, Tempe, AZ (US)

(73) Assignee: Tankless Systems Worldwide Inc., Chandler, AZ (US)

( * ) Notice: Subject to any disclaimer, the term of this patent is extended or adjusted under 35 U.S.C. 154(b) by 18 days.

(21) Appl. No.: 11/207,392

(22) Filed: Aug. 19, 2005

(65) Prior Publication Data

US 2006/0088302 A1 Apr. 27, 2006

Related U.S. Application Data

(60) Provisional application No. 60/604,080, filed on Aug. 24, 2004.

(51) Int. Cl.
*F24H 1/10* (2006.01)

(52) U.S. Cl. ..... 392/478; 392/479; 392/503

(58) Field of Classification Search ..... None
See application file for complete search history.

(56) References Cited

U.S. PATENT DOCUMENTS

| | | | | |
|---|---|---|---|---|
| 787,047 | A * | 4/1905 | Leonard | 338/266 |
| 1,767,715 | A * | 6/1930 | Stoekle | |
| 1,881,444 | A * | 10/1932 | Flanzer | |
| 4,038,519 | A * | 7/1977 | Foucras | |
| 4,180,723 | A * | 12/1979 | Szupillo | |
| 4,581,521 | A * | 4/1986 | Grise | |
| 4,900,896 | A * | 2/1990 | Maus | 392/489 |
| 5,027,425 | A * | 6/1991 | Slomka | |
| 5,434,388 | A * | 7/1995 | Kralik et al. | |
| 5,557,704 | A * | 9/1996 | Dennis et al. | |
| 6,376,816 | B2 * | 4/2002 | Cooper et al. | |
| 6,580,061 | B2 * | 6/2003 | Black | |
| 6,643,454 | B1 * | 11/2003 | Rochelle | |
| 6,909,843 | B1 * | 6/2005 | Fabrizio | |
| 6,943,325 | B2 * | 9/2005 | Pittman et al. | |
| 2004/0146289 | A1 * | 7/2004 | Sakamoto et al. | 392/465 |
| 2005/0185942 | A1 * | 8/2005 | Fabrizio | 392/485 |

* cited by examiner

*Primary Examiner*—Thor Campbell
(74) *Attorney, Agent, or Firm*—Parsons & Goltry; Robert A. Parsons; Michael W. Goltry

(57) ABSTRACT

A fluid heating system includes a fluid supply conduit, a hot fluid conduit, and a fluid heating tube assembly. The fluid heating tube assembly includes an inlet coupling coupled to the fluid supply conduit, an outlet coupling coupled to the hot fluid conduit, and at least one fluid heating tube coupled between the inlet coupling and the outlet coupling. The at least one fluid heating tube includes a tube formed of heat conducting material, a dielectric coating permanently bonded on an outer surface of the tube, and a resistive layer permanently bonded on the dielectric coating. A power distributor is coupled to the fluid heating tube assembly and coupleable to a power source. A switch is coupled between the power distributor and the fluid heating tube assembly to control current flow from the power distributor to the at least one fluid heating tube.

24 Claims, 13 Drawing Sheets

FLUID HEATING SYSTEM

CROSS-REFERENCE TO RELATED APPLICATION

This application claims the benefit of U.S. Provisional Patent Application Ser. No. 60/604,080, filed 24 Aug. 2004.

FIELD OF THE INVENTION

This invention relates to fluid heaters.

More particularly, the present invention relates to tankless water heaters which heat water at the point of use or as a replacement to a water heating system.

BACKGROUND OF THE INVENTION

The need for heated fluids, and in particular heated water, has long been recognized. Conventionally, water has been heated by heating elements, either electrically or with gas burners, while stored in a tank or reservoir. While effective, energy efficiency and water conservation can be poor. As an example, water stored in a hot water tank is maintained at a desired temperature at all times. Thus, unless the tank is well insulated, heat loss through radiation can occur, requiring additional input of energy to maintain the desired temperature. In effect, continual heating of the stored water is required. Additionally, the tank is often positioned at a distance from the point of use, such as the hot water outlet. In order to obtain the desired temperature water, cooled water in the conduits connecting the point of use (outlet) and the hot water tank must be purged before the hot water from the tank reaches the outlet. This can often amount to a substantial volume of water.

Many of these problems have been overcome by the use of tankless water heaters. Heating water accurately and efficiently in a consistent and safe manner can be problematic with current tankless systems.

It would be highly advantageous, therefore, to remedy the foregoing and other deficiencies inherent in the prior art.

Accordingly, it is an object the present invention to provide a new and improved fluid heater.

Another objective of the present invention is to provide a tankless water heater.

And another object of the present invention is to provide a tankless water heater that can be employed as a point of use water heater and as a stand alone system.

SUMMARY OF THE INVENTION

Briefly, to achieve the desired objects of the present invention in accordance with a preferred embodiment thereof, provided is a fluid heating unit including a fluid heating tube assembly having a fluid heating tube with a tube formed of heat conducting material having an inlet end, an outlet end and a flow path extending therethrough. A dielectric coating is permanently bonded on an outer surface of the tube intermediate the inlet end and the outlet end, and a resistive layer is permanently bonded on the dielectric coating. A power distributor is coupled to the fluid heating tube assembly and coupleable to a power source. A switch is coupled to the power distributor and the fluid heating tube assembly, the switch being movable between an open position preventing current flow to the heating tube and a closed position allowing fluid flow to the heating tube.

In a specific aspect, the fluid heating unit includes a thermal sensor coupled to the fluid heating tube assembly, a flow sensor coupled to the fluid heating tube assembly, and a control mechanism receiving fluid flow data and fluid temperature data from the flow sensor and the thermal sensor, respectfully, and moving the switch between the open position and the closed position upon selected fluid flow and fluid temperature data.

In yet another aspect, the fluid heating tube assembly includes a second fluid heating tube with a tube formed of heat conducting material having an inlet end, an outlet end and a flow path extending therethrough. A dielectric coating is permanently bonded on an outer surface of the tube intermediate the inlet end and the outlet end, and a resistive layer is permanently bonded on the dielectric coating. The inlet end of the second fluid heating tube is coupled to the outlet end of the fluid heating tube, and the second fluid heating tube is coupled to the power distributor.

In additional aspects of the invention, the second heating tube is coupled to a second switch. The control mechanism receives fluid flow data and fluid temperature data from the flow sensor and the thermal sensor, respectfully, and moves the switch between the open position and the closed position upon selected fluid flow and fluid temperature data, and independently moves the second switch between the open position and the closed position upon selected fluid flow and fluid temperature data.

Also provided is a fluid heating tube including a tube formed of heat conducting material having a first end, a second end, and a flow path extending therethrough. A dielectric coating is permanently bonded on an outer surface of the tube, and a resistive layer is permanently bonded on the dielectric coating, wherein the tube, dielectric coating, and resistive layer have generally equivalent thermal coefficients of expansion.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF THE PREFERRED EMBODIMENTS

Figure 1:
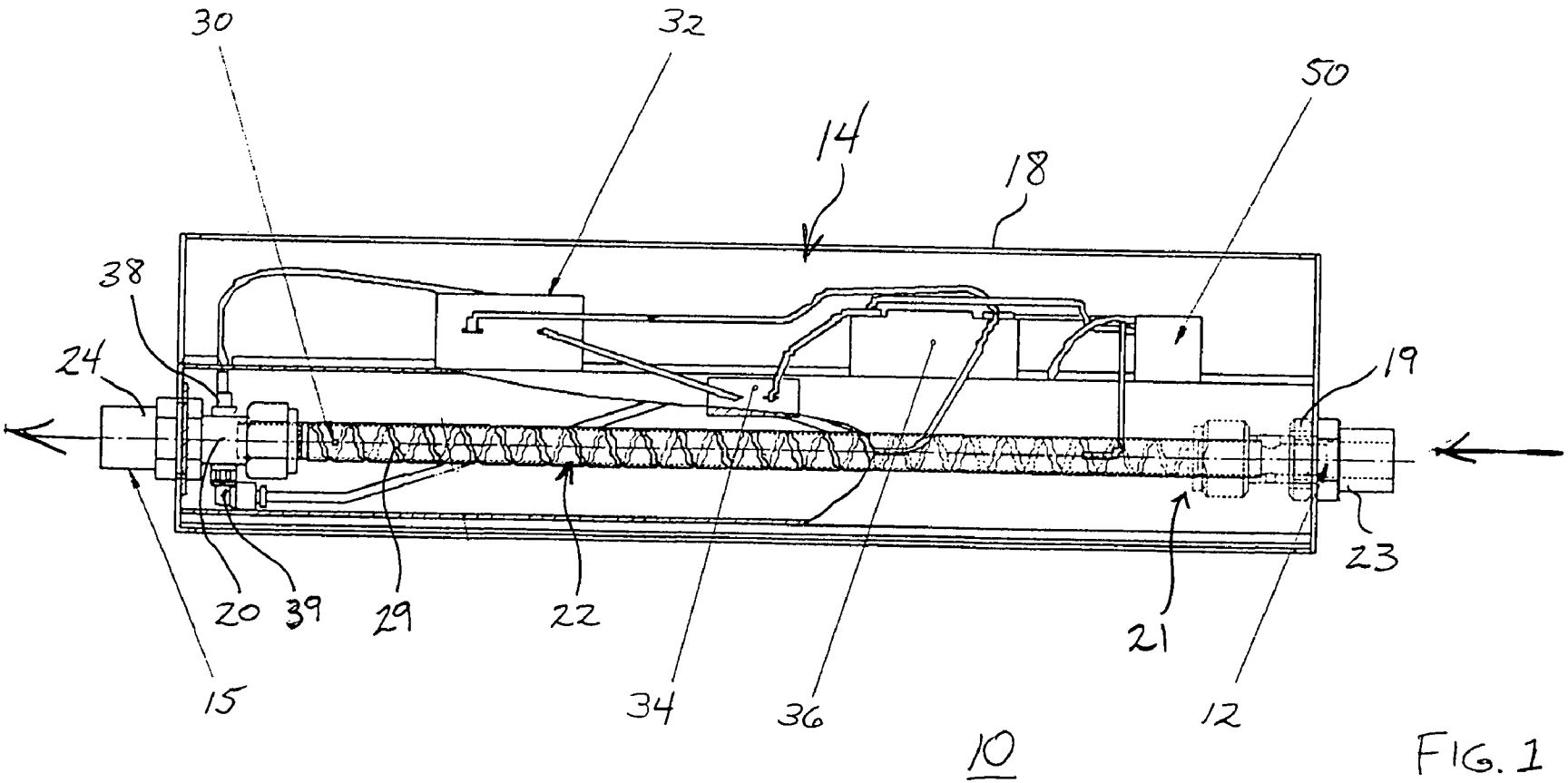
FIG. 1 is a sectional side view of a point of use water heating system according to the present invention.

Turning now to the drawings in which like reference characters indicate corresponding elements throughout the several views, attention is first directed to FIG. 1 which illustrates a point of use water heating system, generally designated 10. System 10 includes a water supply conduit 12, a water heating unit 14 and a hot water conduit 15. Water is supplied to water heating unit 14 through water supply conduit 12, and hot water is dispensed from water heating unit 14 through hot water conduit 15. Water heating unit 14 includes a housing 18 carrying a heating tube assembly 21. Heating tube assembly 21 includes a heating tube 22 extending between an inlet coupling 19 and an outlet coupling 20. An inlet end 23 of heating tube 22 is coupled to inlet coupling 19 and an outlet end 24 of heating tube 22 is coupled to outlet coupling 20. A control circuit 25 controls water heating unit 14 by monitoring water flow and water temperature. One skilled in the art will understand that fluids other than water can also be heating using the present invention.

Heating tube 22 includes a tube formed of heat conducting material such as copper, stainless steel, etc., having a dielectric coating 29 permanently bonded on an outer surface thereof and a resistive layer 30 permanently bonded on dielectric coating 29. Resistive layer 30 will be understood to include many possible designs, such as being a layer substantially coating dielectric coating 29, multiple strips extending from a contact, zigzag, curves, and the like, so as to form a continuous current path of resistive material along the tube on dielectric coating 29. Dielectric coating 29 and resistive layer 30 are implemented using dielectric heating technology in either the sprayed or thick film application form. While other shapes/designs can be employed, resistive layer 30 is preferably formed of resistive material formed in a spiral pattern from inlet end 23 to outlet end 24, to increase the uniformity of heat applied to the tube.

Upon application of current to resistive layer 30, heat is generated. The generated heat is absorbed by the tube and water passing through the tube in a flow path from inlet end 23 to outlet end 24. In order to prevent damage to dielectric coating 29 and resistive layer 30, the materials selected for each have a thermal coefficient of expansion similar to the thermal coefficient of expansion of the heat conducting material used for the tube of heating tube 22. Thus, as the material of the tube expands and contracts due to the influence of heat generated, dielectric coating 29 and resistive layer 30 each contract and expand sufficiently similarly to prevent damage thereto. One skilled in the art will understand that while the materials may not have identical thermal coefficients of expansion, they can have generally equivalent values which are sufficiently close to prevent major damage upon application of heat. The amount of heat generated is dependent upon the resistive material used as measured in watts per inch. The degree to which water passing through the tube is heated is dependent upon the heat generated, the surface area of the resistive layer, and the flow rate of the water through heating tube 22.

Figure 2:
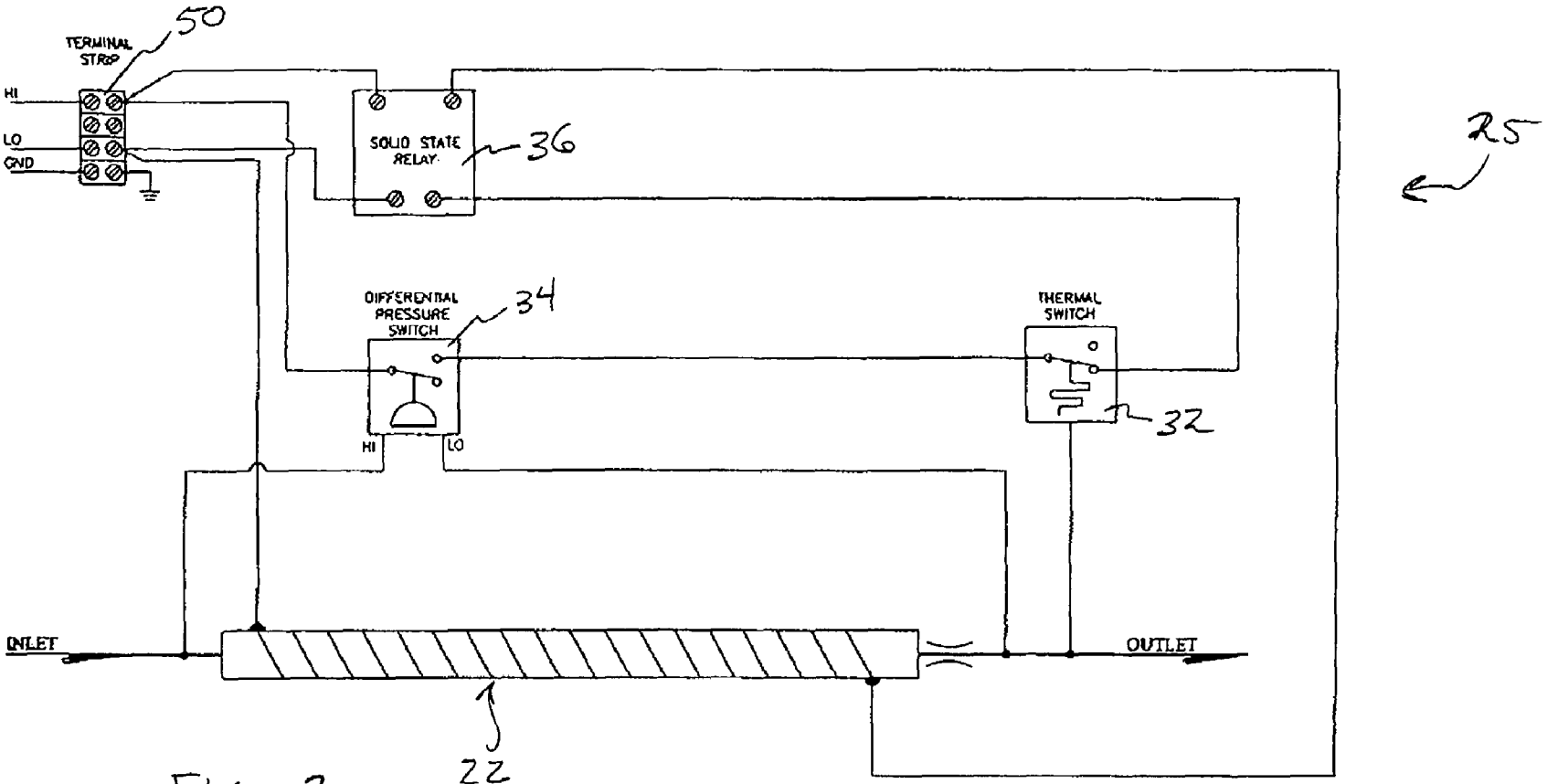
FIG. 2 is a schematic diagram of a control circuit of the point of use water heating system of FIG. 1.

With additional reference to FIG. 2, control circuit 25 includes a thermal shut off switch 32, a pressure differential switch 34, and a solid-state relay 36. A thermal sensor 38 is coupled to thermal shut off switch 32 and carried in outlet coupling 20 in fluid communication with water passing into hot water conduit 15. A pressure port 39 is formed in each of inlet coupling 19 and outlet coupling 20, and coupled to pressure differential switch 34. Pressure differential switch 34 and thermal shut off switch 32 are connected in series to solid-state relay 36 to actuate relay 36 between an open position and a close position allowing current flow through and preventing current flow, respectively, to heating tube 22. Thermal shut off switch 32 can be preset to a designated temperature at which current to resistive layer 30 is removed, halting heating of water in heating tube 22. Additionally, pressure differential switch 34 along with pressure ports 39 form a flow sensor which prevents current from being applied to resistive 30 unless water is flowing through heating tube 22.

Water flow is determined by a pressure differential between the ends of heating tube 22 indicating water flow. In other words, if water is not flowing through heating tube 22, a constant pressure is maintained from inlet end and outlet end thereof. As, for example, a faucet is opened, water flow through heating tube 22 results in a higher pressure at the inlet end that the outlet end resulting from back pressure. Pressure differential switch 34 permits current to be applied to resistive layer 30 detects the flow of water through heating tube 22. Since thermal shut off switch 32 and pressure differential switch 34 are coupled in series, the water heating unit 14 will not operate to heat water unless there is water flow as determined by pressure differential switch 34 and a predetermined temperature has not been reached as determined by thermal shut off switch 32. If either the predetermined temperature is reached or water flow is shut off, heating tube 22 is turned off. A power distributor 50 receives power from a power source, not shown, for applying current to resistive layer 30 through solid-state relay 36 upon appropriate conditions as described previously.

It will be understood by those skilled in the art that control system 25 can be simply an on/off switch manually actuated, or more complex sensors and controls. Additionally, various combination of sensors collecting data such as water flow or temperature can be employed singally or in combination. Additional control features are described in connection with FIG. 3.

Figure 3:
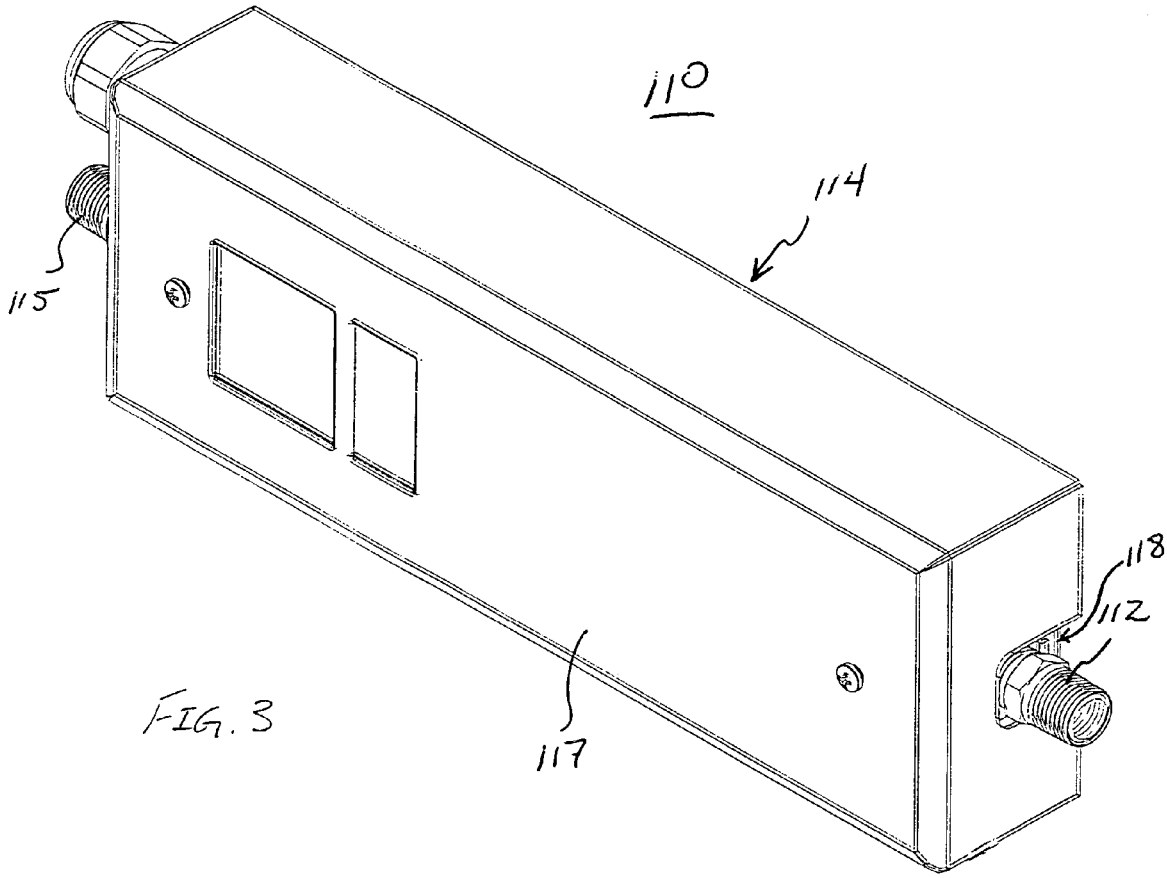
FIG. 3 is a perspective view of another embodiment of a water heater according to the present invention.

Turning now to FIG. 3, illustrated is another embodiment of a water heater system generally designated 110. Water heater system 110 is a system which heats water as its flows through. Electrical power is conserved by heating water only as it is needed. System 110 includes a water supply conduit 112, a water heating unit 114 and a hot water conduit 115. Water is supplied to water heating unit 114 through water supply conduit 112, and hot water is dispensed from water heating unit 114 through hot water conduit 115. Water heating unit 14 includes housing 118 closed by a cover 117.

Figure 4:
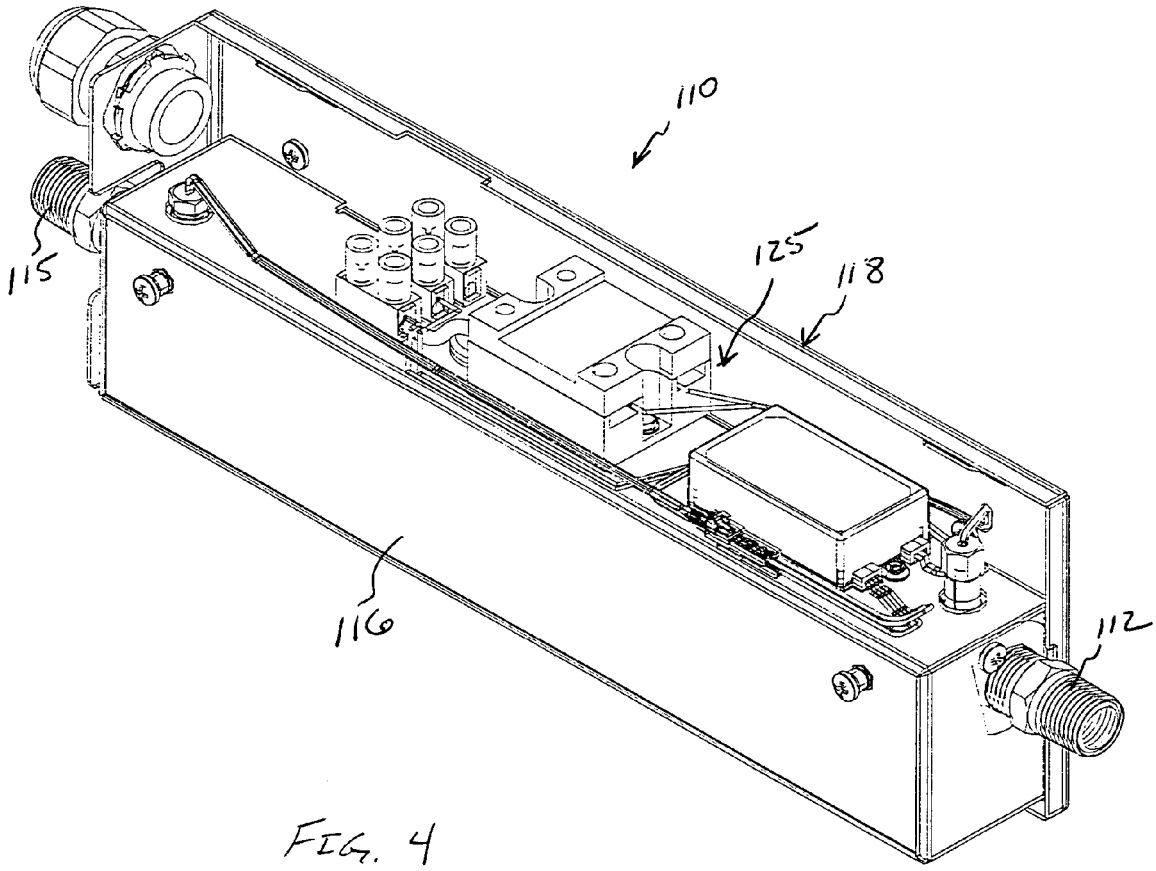
FIG. 4 is a perspective view of the water heater of FIG. 3 with the cover removed.

Referring to FIG. 4, water heater system 110 is illustrated with cover 117 removed. Housing 118 includes apertures on opposing ends to permit passage of supply conduit 112 and hot water conduit 115 therethrough. Housing 118 also includes a protective divider 116 for separating a heating tube assembly 121 (FIG. 5) from a control circuit 125.

Figure 5:
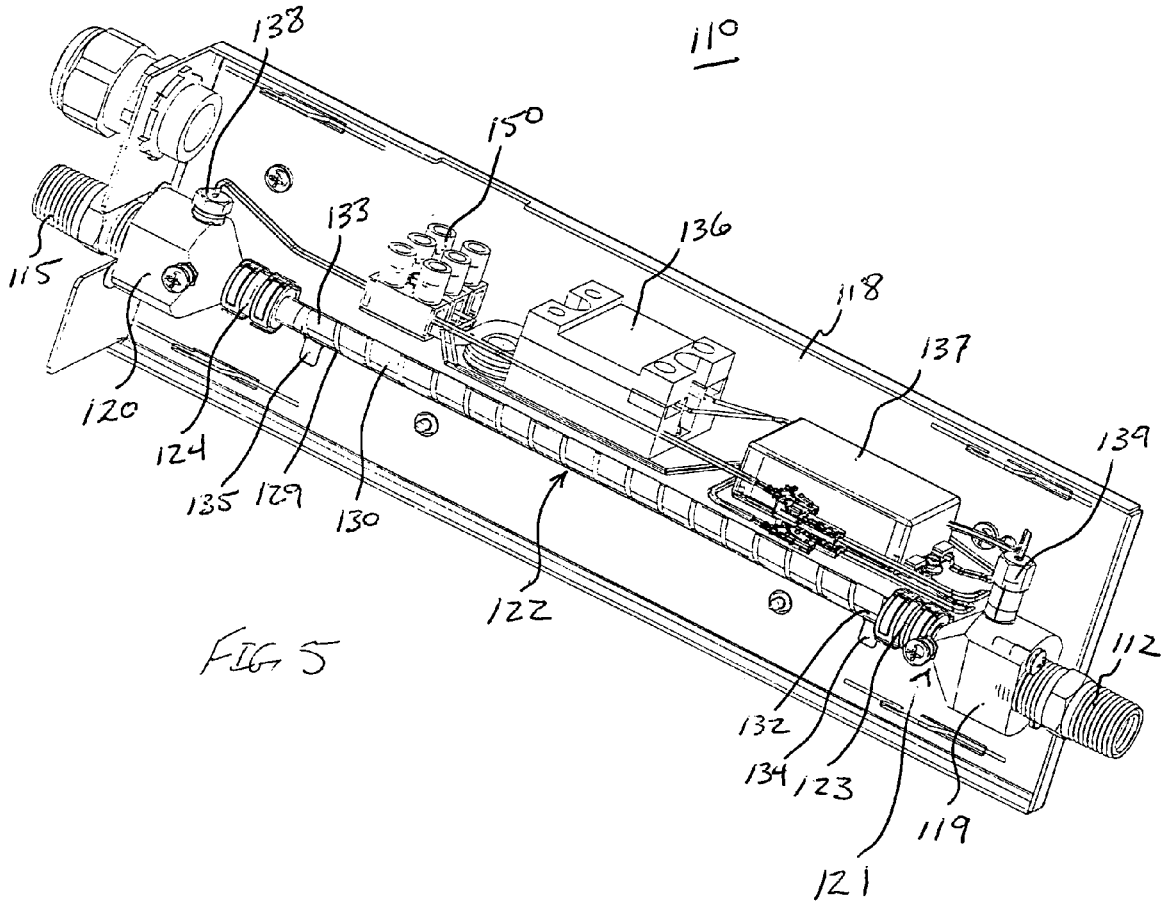
FIG. 5 is a perspective view of the water heater of FIGS. 3 and 4 with the protective divider removed.

FIG. 5 illustrates water heater system 110 with divider 116 removed. Heating tube assembly 121 includes an inlet coupling 119 and an outlet coupling 120 coupling heating tube 122 between supply conduit 112 and hot water conduit 115. Heating tube 122 extends between inlet coupling 119 and outlet coupling 120 with an inlet end 123 coupled to inlet coupling 119 and an outlet end 124 coupled to outlet coupling 120. Control circuit 125 controls water heating unit 114 by monitoring water flow and water temperature.

Figure 6:
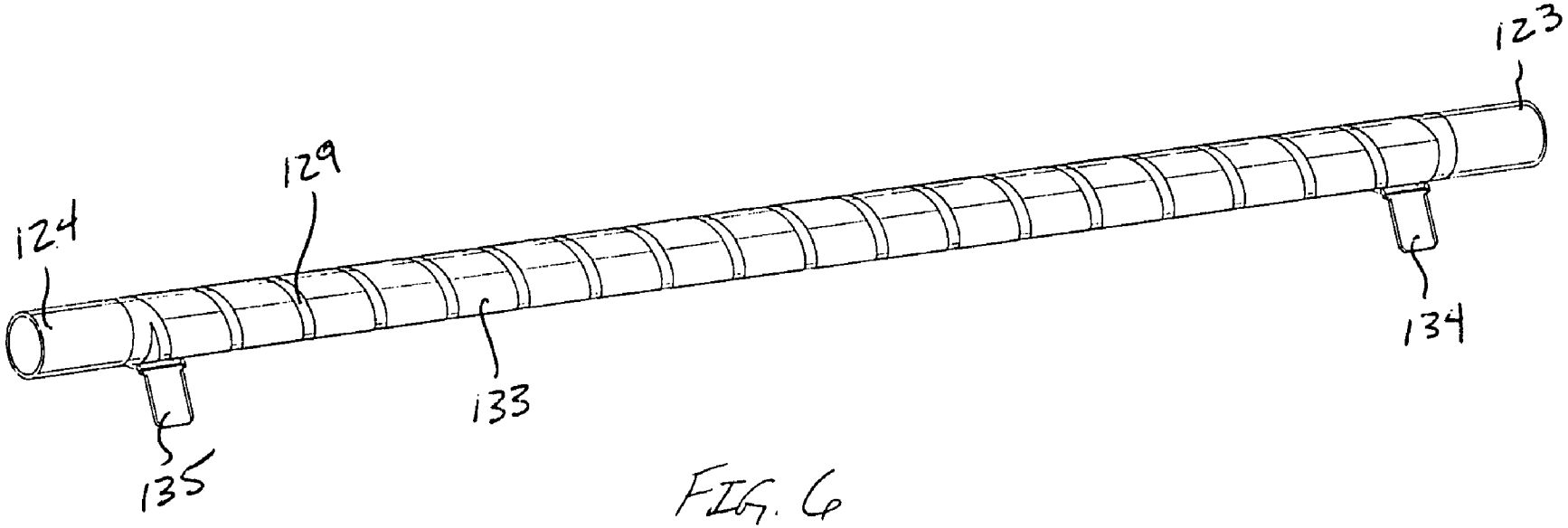
FIG. 6 is a perspective view of the heating tube of FIG. 5.

With additional reference to FIG. 6, heating tube 122 includes a tube formed of heat conducting material such as copper, stainless steel, etc., having a dielectric coating 129 permanently bonded on an outer surface thereof and a resistive layer 130 permanently bonded on dielectric coating 129. Dielectric coating 129 and resistive layer 130 are substantially the same as those discussed in connection with heating tube 22 and thus will not be described in further detail. Resistive layer 130 has an end 132 and an opposing end 133. Resistive layer 130 is formed preferably in a spiral pattern with end 132 proximate inlet end 123 and opposing end 133 proximate outlet end 124. Upon application of current to resistive layer 130, heat is generated. Current is applied through a contact 134 extending from resistive layer 130 proximate end 132 and a contact 135 proximate end 133. The generated heat is absorbed by the tube and water passing through the tube in a flow path from inlet end 123 to outlet end 124.

Control circuit 125 includes a switch, which in this embodiment is a solid-state relay 136 and a control module 137. A thermal sensor 138 is coupled to heating tube assembly 121 so as to determine the temperature of outflowing fluid from the flow path. A flow sensor 139 is coupled to heating tube assembly 121 so as to determine the rate of flow, or if there is flow of fluid through the flow path. In each case, the sensors can be mounted to heating tube 122, inlet coupling 119, or outlet coupling 120, depending on what is being sensed. Various types of sensors for measuring temperature and flow can also be employed, some of which may have elements in the flow path or only adjacent thereto. In the present embodiment, thermal sensor 138 is carried by outlet coupling 120 and flow sensor 139 is carried by inlet coupling 119.

Data from thermal sensor 138 and flow sensor 139 are received by control module 137 which, upon appropriate data, actuates relay 136. Solid-state relay 136 is switched between a closed position and an open position allowing current flow through and preventing current flow, respectively, to heating tube 122. Control module 137 can be preset to a designated temperature at which current to resistive layer 130 is removed by opening relay 136, halting heating heating tube 122. Additionally, control module 137 can prevent current from being applied to resistive layer 130 unless water is flowing through heating tube 122. A power distributor 150 receives power from a power source, not shown, for applying current to resistive layer 130 through solid-state relay 136 upon appropriate conditions as described previously.

Figure 7:
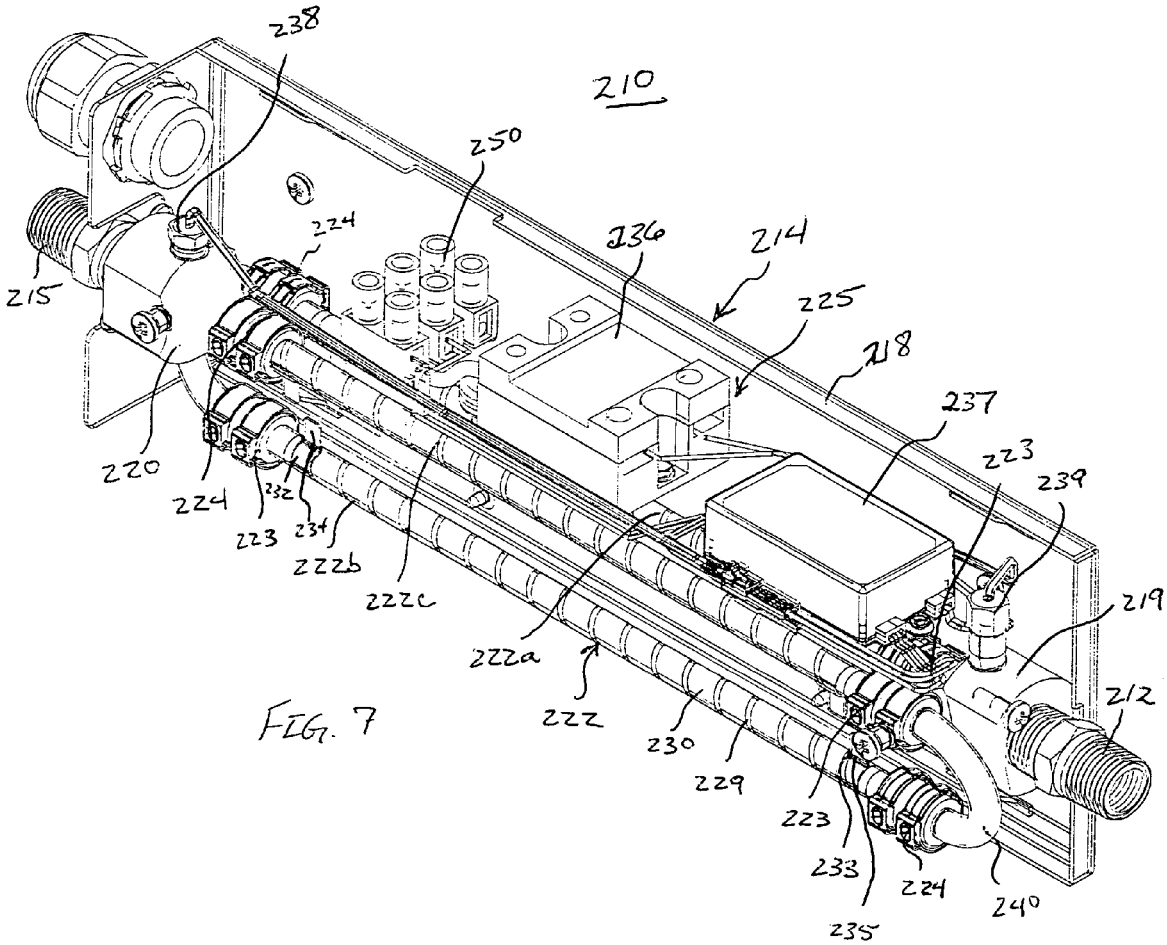
FIG. 7 is a perspective view of another embodiment of a water heater according to the present invention.

Turning now to FIG. 7, yet another embodiment of a water heater system generally designated 210 is illustrated. System 210 includes a water supply conduit 212, a water heating unit 214 and a hot water conduit 215. Water heating unit 214 includes housing 218 closed by a cover which is not shown, but generally similar to that of system 110. Housing 218 includes apertures on opposing ends to permit passage of supply conduit 212 and hot water conduit 215 therethrough. As with system 110, housing 218 can include a protective divider.

Water heating unit 214 includes a heating tube assembly 221 and a control circuit 225. Control circuit 225 is substantially identical to control circuit 125 with slight differences due to differences in heating tube assembly 221. Heating tube assembly 221 includes an inlet coupling 219 and an outlet coupling 220 coupling a plurality of heating tubes 222 between supply conduit 212 and hot water conduit 215. Control circuit 225 controls heating tube assembly 221 by monitoring water flow and water temperature.

Figure 8:
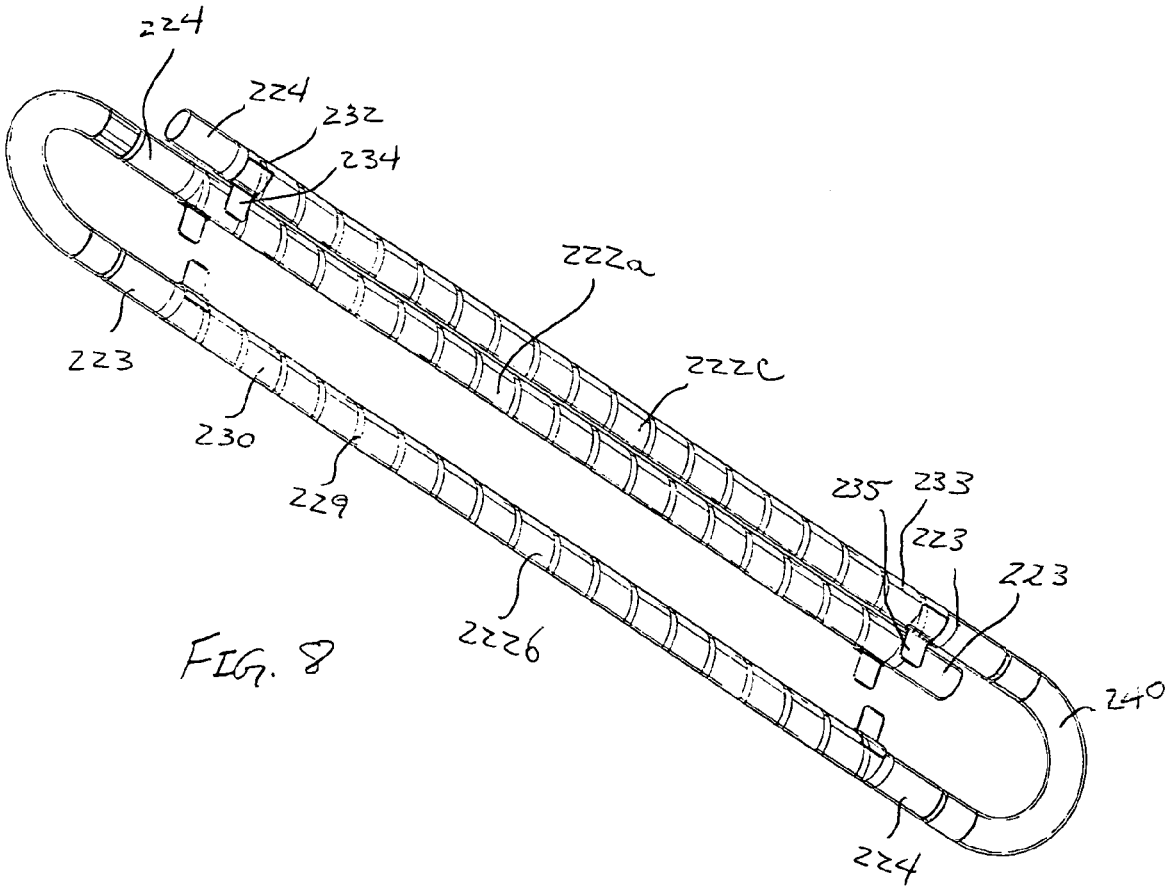
FIG. 8 is a perspective view of a portion of the heating tube assembly of FIG. 7.

With additional reference to FIG. 8, heating tube assembly 222 includes a plurality of heating tubes, designated 222*a*, 222*b*, and 222*c*. Each heating tube 222*a*, 222*b*, and 222*c* includes a tube formed of heat conducting material such as copper, stainless steel, etc., and having an inlet end 223 and an outlet end 224. A dielectric coating 229 is permanently bonded on an outer surface of the tube and a resistive layer 230 is permanently bonded on dielectric coating 229. Resistive layer 230 is formed of electrically resistive material available from known vendors and having an end 232 and an opposing end 233. Resistive layer 230 is preferably formed in a spiral pattern with end 232 proximate inlet end 223 and opposing end 233 proximate outlet end 224. Heating tubes 222, dielectric coating 229 and resistive layer 230 are substantially the same as those discussed in connection with heating tube 22 and 122, and thus will not be described in further detail. It will be understood that while three heating tubes are employed in the present embodiment, substantially any number of heating tube from one to a great many can be employed in the various embodiments.

Current is applied through a contact 234 extending from resistive layer 230 proximate end 232 and a contact 235 proximate end 233 of each heating tube 222. The generated heat is absorbed by the tube and water passing through the tube in a flow path from inlet end 223 to outlet end 224. Heating tubes 222 are coupled in series. Thus, inlet end 223 of heating tube 222*a* is coupled to inlet coupling 219 and outlet end 224 is coupled to inlet end 223 of heating tube 222*b*. Outlet end 224 of heating tube 222*b* is coupled to inlet end 223 of heating tube 222*c*, with outlet end 224 of heat tube 222*c* coupled to outlet coupling 220. Heating tubes 222*a*, 222*b*, and 222*c* can be coupled in various manners, such as employing header blocks and the like, or, as illustrated herein, using curved tube elements 240 such as to place each heating tube 222 substantially parallel to one another. This can greatly reduce the footprint of heating unit 214.

Control circuit 225 includes a switch such as solid-state relay 236 and a control module 237. A thermal sensor 238 is is coupled to heating tube assembly 221 so as to determine the temperature of outflowing fluid from the flow path. A flow sensor 239 is coupled to heating tube assembly 221 so as to determine the rate of flow, or simply if there is or is not a flow of fluid through the flow path. In this embodiment, thermal sensor is carried by outlet coupling 220 to determine the temperature of water passing into hot water conduit 215. Flow sensor 239 is carried by inlet coupling 219 to determine if there is a flow of water passing into heating tube assembly 221 from supply conduit 212. Data from thermal sensor 238 and flow sensor 239 are received by control module 237 which, upon appropriate data, actuates relay 236. Solid-state relay 236 is switched between a closed position and an open position allowing current flow and preventing current flow, respectively, to heating tube assembly 221. Since this embodiment includes a plurality of heating tubes 222, solid state relay is coupled to each to provide current to contacts 234 and 235.

Figure 9:
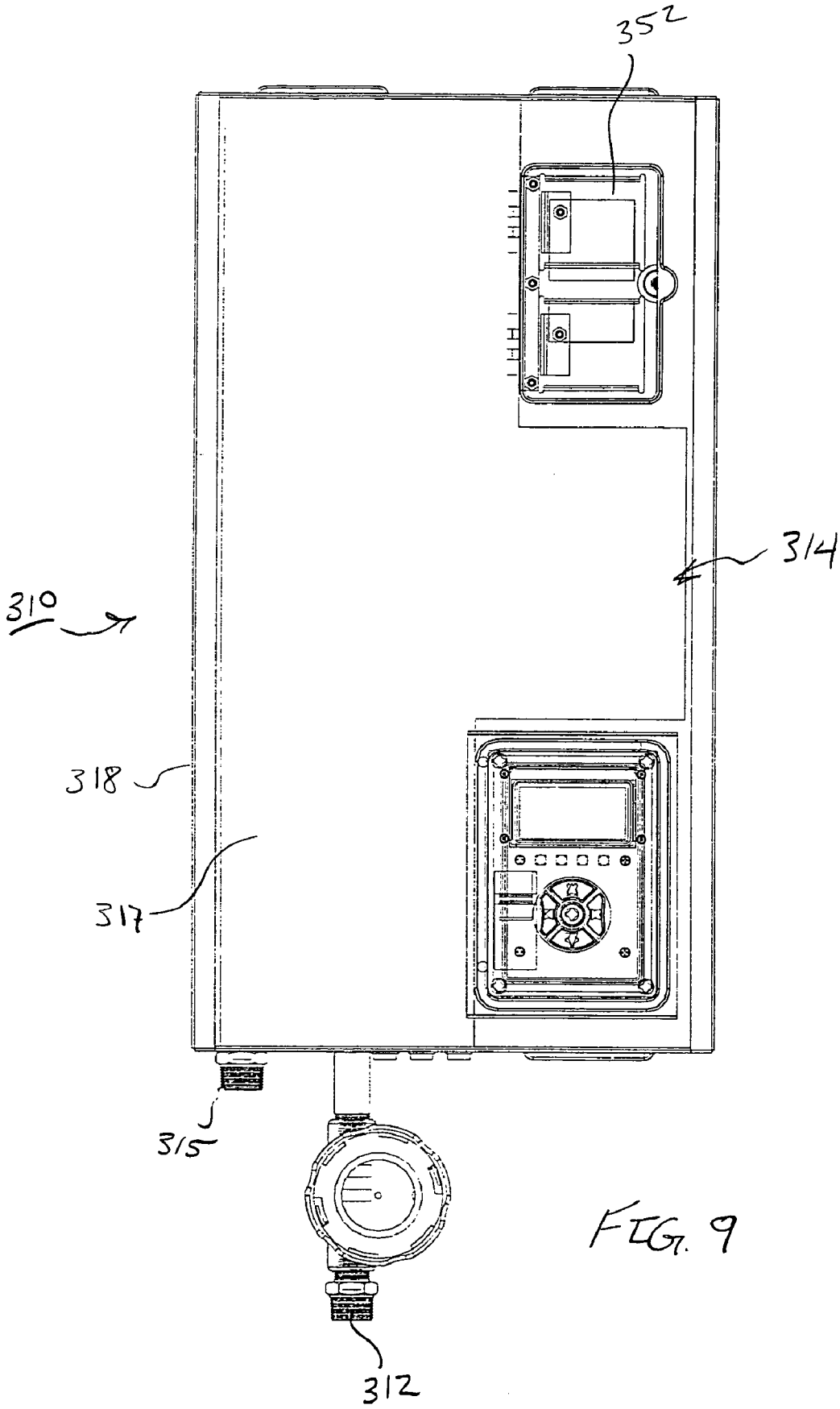
FIG. 9 is a perspective view of yet another embodiment of a water heater according to the present invention.

Turning now to FIG. 9, yet another embodiment of a water heater system generally designated 310 is illustrated. Water heater system 310 is a system which heats water as its flows through, but which can be employed to replace an existing water heating system for an entire house, building, and the like. In effect, system 310 can be of sufficient capacity to supply hot water (or other fluids) to, for example, and entire house as opposed to a single point of use. Electrical power is conserved by heating water only as it is needed. As water needs are increased, increasing amounts of energy are added to the flowing water to reach a desired temperature. System 310 includes a water supply conduit 312, a water heating unit 314 and a hot water conduit 315.

Water is supplied to water heating unit 314 through water supply conduit 312, and hot water is dispensed from water heating unit 314 through hot water conduit 315. Water heating unit 314 includes housing 318 closed by a cover 317.

Figure 10:
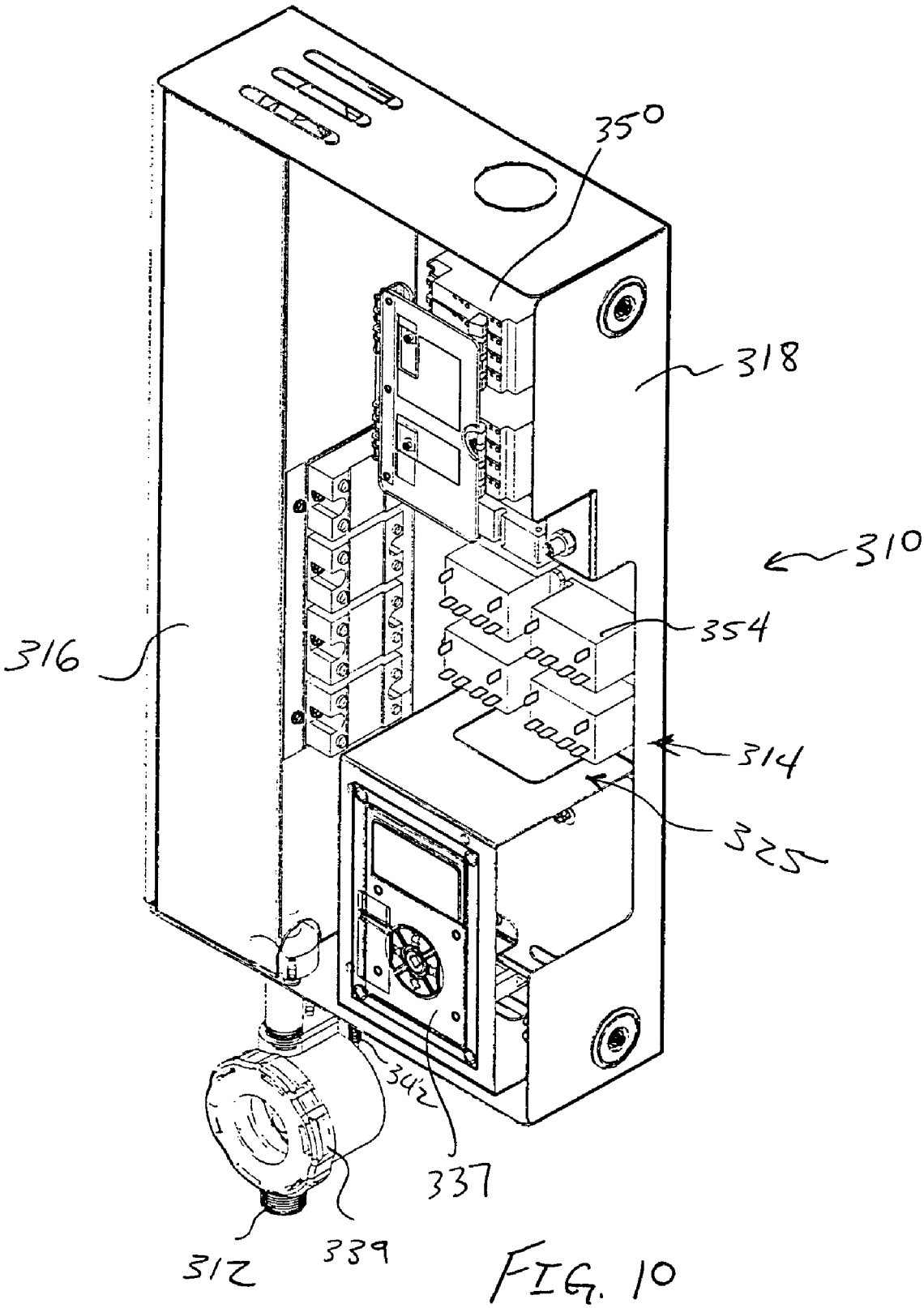
FIG. 10 is a perspective view of the water heater of FIG. 3 with the cover removed.

Referring to FIG. 10, water heater system 310 is illustrated with cover 317 removed. Housing 318 includes a protective divider 316 for separating a heating tube assembly 321 (FIG. 11) from a control circuit 325.

Figure 11:
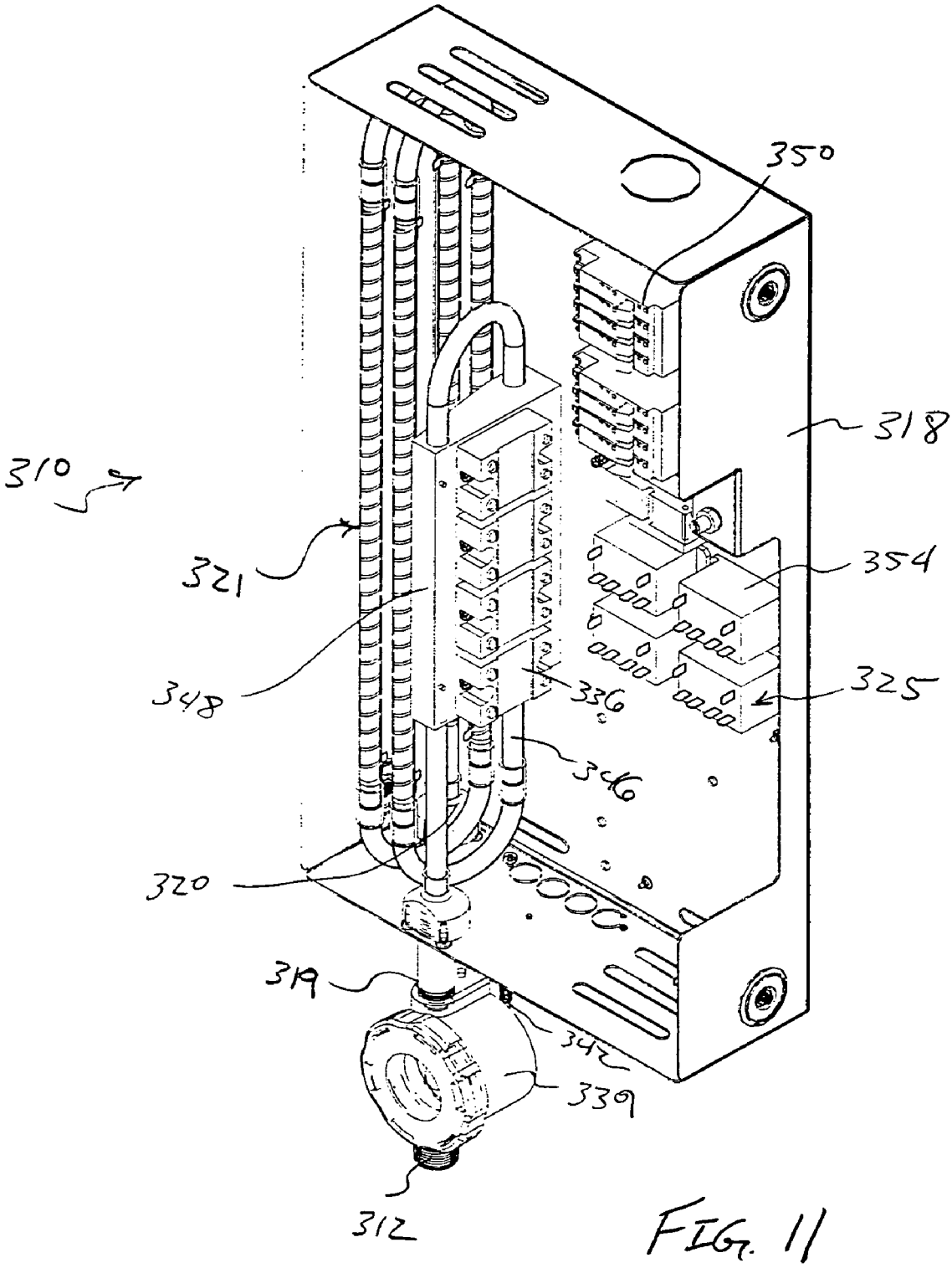
FIG. 11 is a perspective view of the water heater of FIGS. 3 and 4 with the protective divider removed.

FIG. 11 illustrates water heater system 310 with divider 316 removed. Heating tube assembly 321 includes an inlet coupling 319 and an outlet coupling 320 coupling a plurality of heating tubes 322 between supply conduit 312 and hot water conduit 315. Control circuit 325 controls heating tube assembly 221 by monitoring water flow and water temperature.

Figure 12:
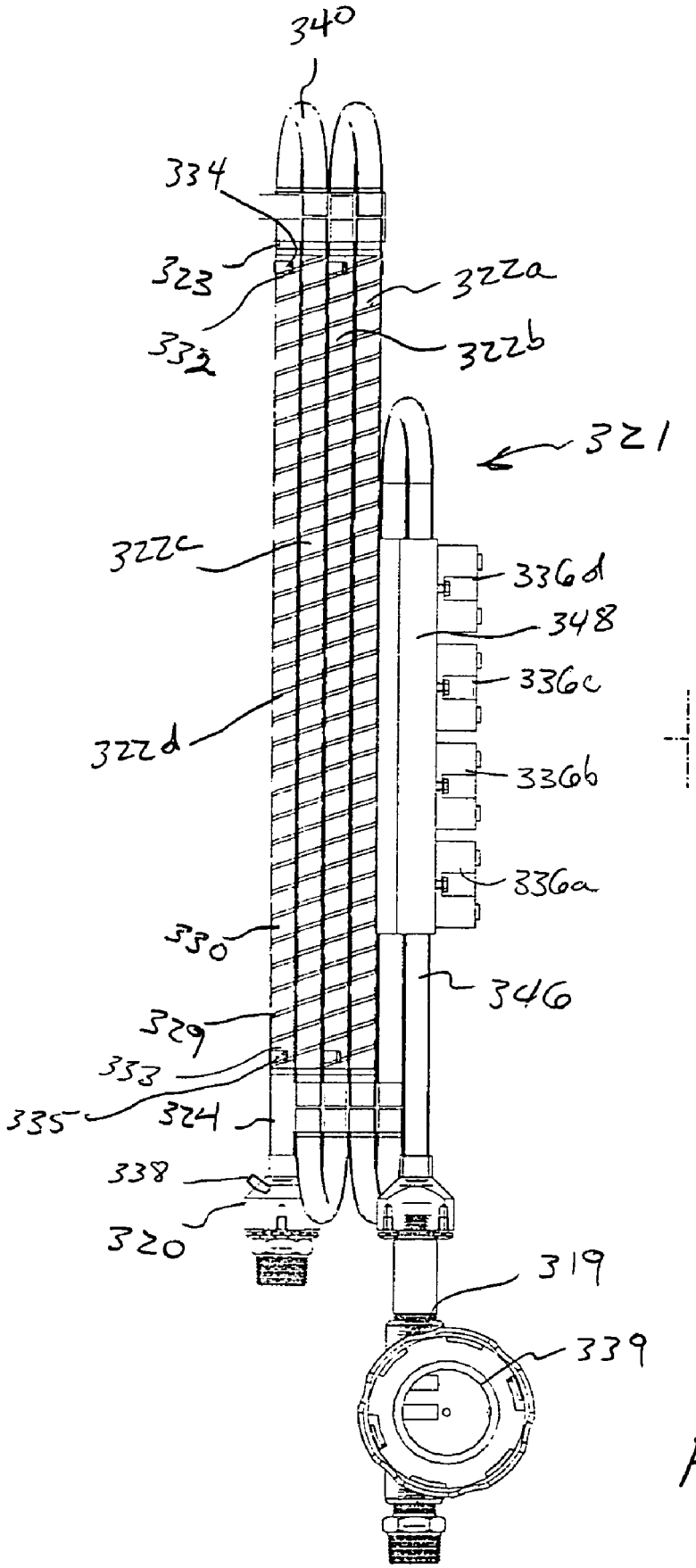
FIG. 12 is a perspective view of the heating tube assembly of FIG. 11.
Figure 13:
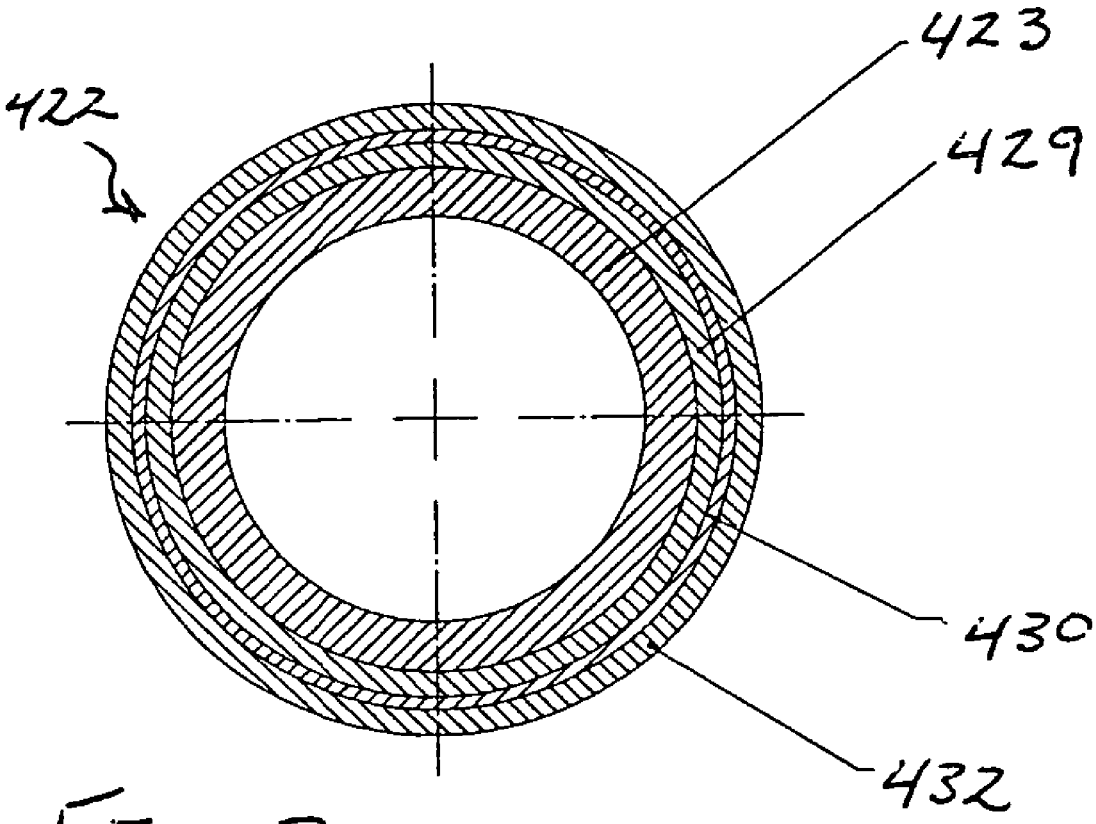
FIG. 13 is a sectional view of another embodiment of a heating tube.

With additional reference to FIG. 12, heating tube assembly 322 includes a plurality of heating tubes, designated 322*a*, 322*b*, 322*c*, and 322*d*. Each heating tube 322*a*, 322*b*, 322*c*, and 322*d* includes a tube formed of heat conducting material such as copper, stainless steel, etc., and having an inlet end 323 and an outlet end 324. A dielectric coating 329 is permanently bonded on an outer surface of the tube and a resistive layer 330 is formed on dielectric coating 329. Resistive layer 330 is formed of electrically resistive material available from known vendors and having an end 332 and an opposing end 333. Resistive layer 330 is preferably formed in a spiral pattern with end 332 proximate inlet end 323 and opposing end 333 proximate outlet end 324. Heating tubes 322, dielectric coating 329 and resistive layer 330 are substantially the same as those discussed in connection with heating tube 22, 122, and 222 and thus will not be described in further detail.

Current is applied through a contact 334 extending from resistive layer 330 proximate end 332 and a contact 335 proximate end 333 of each heating tube 322. The generated heat is absorbed by the tube and water passing through the tube in a flow path from inlet end 323 to outlet end 324. Heating tubes 322 are preferably coupled in series. Thus, inlet end 323 of heating tube 322*a* is coupled to inlet coupling 319 and outlet end 324 is coupled to inlet end 323 of heating tube 322*b*. Outlet end 324 of heating tube 322*b* is coupled to inlet end 323 of heating tube 322*c*, with outlet end 324 of heat tube 322*c* coupled to inlet end 323 of heating tube 322*d*. Outlet end 324 of heating tube 322*d* is coupled to outlet coupling 320. Heating tubes 322*a*, 322*b*, 322*c*, and 322*d* can be coupled in various manners, such as employing header blocks and the like, or, as illustrated herein, using curved tube elements 340 such as to place each heating tube 322 substantially parallel to one another. This can greatly reduce the footprint of heating unit 314.

Referring back to FIGS. 10, 11, and 12, control circuit 325 includes a plurality of switches, such as solid-state relays 336*a, b, c*, and *d* associated with heating tubes 322*a, b, c*, and *d*, respectively, and a control module 337. A thermal sensor 338 is is coupled to heating tube assembly 321 so as to determine the temperature of outflowing fluid from the flow path. A flow sensor 339 is coupled to heating tube assembly 321 so as to determine the rate of flow, or simply if there is or is not a flow of fluid through the flow path. In this embodiment, thermal sensor is carried by outlet coupling 320 to determine the temperature of water passing into hot water conduit 315. Flow sensor 339 is carried by inlet coupling 319 to determine if there is a flow of water passing into heating tube assembly 321 from supply conduit 312. Data from thermal sensor 338 and flow sensor 339 are received by control module 337 which, upon appropriate data, actuates selected ones of relays 336*a–d*. Solid-state relays 336*a–d* are switched between a closed position and an open position allowing current flow and preventing current flow, respectively, to corresponding heating tubes 322*a–d*. Since this embodiment includes a plurality of heating tubes, a solid state relay is coupled to each to independently provide current to contacts 334 and 335.

A power distributor includes a terminal and breaker switch combination 350 to provide safety and reduce associated elements needed for installation. Breakers 350 can be accessed through a hinged panel 352 (FIG. 9) in cover 317. No separate or outside breaker box is necessary for the installation of system 310. Control module 337 receives water flow and water temperature data, controlling heater tubes 322*a–d* by actuating selected ones of or all of solid-state relay switches 336*a–d*. System 310, in this embodiment, also includes mechanical relays 354*a, b, c*, and *d*, one for each solid state relay 336*a–d*, which act as safety shut-offs when a predetermined temperature is equaled or exceeded. These relays are coupled to thermal sensor 338 and flow sensor 339, but not coupled to control module 337 and are thus independent therefrom. Electrical power runs from breakers 350 through mechanical relays 354*a–d* to solid state relays 336*a–d*, respectively. When signaled from control module 337, relays 336*a–d* provide power to heating tubes 322*a–d*, respectively, and independently.

With reference to FIGS. 10 and 11, data is provided to control module 337 by flow sensor 339 carried by inlet coupling 319. In this embodiment, flow sensor 339 is a paddle wheel pulse flow sensor which allows the volume of water entering heater tube assembly 321 to be measured. In addition to thermal sensor 338 measuring the outlet fluid temperature, there can be included an inlet temperature sensor 342 carried by inlet coupling 319 to measure the temperature of the incoming fluid. Temperature sensors 338 and 342 allow the temperature of water entering and exiting heating tube assembly 321 to be measured. This data is employed by control module 337 to activate one or more heating tubes 322*a–d*, activated through solid state relay switches 336*a–d*. Various methodologies can be employed to control and adjust the operation of the heating tubes. This is typically controlled by software within control module 337.

Still referring to FIGS. 11 and 12 solid state relays 336*a–d* generate heat as they are used. This heat can build up, and can degrade the operation of the relays over time. The heat generated by relays 336 is generally wasted heat. System 310 employs the heat generated by relays 336 to add energy to heating tube assembly 321. Additional piping 346 is coupled between inlet end 324 of heating tube 322*a* and inlet coupling 319. Piping 346 runs through a heatsink block 348 to which relays 336 are attached. As relays 336 generate heat energy, heatsink block 348 transmits the heat to piping 346 and thus incoming fluid passing therethrough. In this manner, heat is pulled from relays 336 and added to the heating tube assembly 321.

Fluid heating system 310 can include multiple sensors, for providing data to control module 337 allowing for greater control and adjustability. Additionally, control module 337 can be employed as disclosed in co-pending application entitled, "Modular Tankless Water Heater Control Circuitry and Method of Operation", Ser. No. 11/080,120, filed 4 Mar. 2005 and included herein by reference.

Another embodiment of a heating tube generally designated Heating tube 422 is illustrated in cross-section. Heating tube 422 is substantially similar to those heating tubes previously described, including a tube 423 formed of heat conducting material such as copper, stainless steel, etc., having a dielectric coating 429 permanently bonded on an outer surface thereof and a resistive layer 430 permanently bonded on dielectric coating 429. In this embodiment, however, an additional layer is provided. Another dielectric layer 432 is formed overlying resistive layer 430. Dielectric layer 432 is employed as a protective coating preventing inadvertent injury which may result from contact with resistive layer 430 when current is flowing therethrough.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

The invention claimed is:

1. A fluid heating unit comprising:

a fluid heating tube assembly including a first fluid heating tube with a tube formed of heat conducting material having an inlet end, an outlet end and a flow path extending therethrough, a dielectric coating permanently bonded on an outer surface of the tube intermediate the inlet end and the outlet end, and a resistive layer formed on the dielectric coating, and a second fluid heating tube with a tube formed of heat conducting material having an inlet end, an outlet end and a flow path extending therethrough, a dielectric coating permanently bonded on an outer surface of the tube intermediate the inlet end and the outlet end, and a resistive layer formed on the dielectric coating, the inlet end of the second fluid heating tube coupled to the outlet end of the first fluid heating tube;

a power distributor coupled to the fluid heating tube assembly and coupleable to a power source;

a first switch coupled to the power distributor and the first fluid heating tube, the first switch movable between an open position preventing current flow to the first fluid heating tube and a closed position allowing current flow to the first fluid heating tube; and a second switch coupled to the power distributor and the second fluid heating tube, the second switch movable between an open position preventing current flow to the second fluid heating tube and a closed position allowing current flow to the second fluid heating tube.

2. A fluid heating unit as claimed in claim 1 further including:

a thermal sensor coupled to the fluid heating tube assembly; and a control mechanism receiving fluid temperature data from the thermal sensor and moving the first switch between the open position and the closed position upon selected fluid temperature data and moving the second switch between the open position and the closed position upon selected fluid temperature data.

3. A fluid heating unit as claimed in claim 1 further including:

a flow sensor coupled to the fluid heating tube assembly; and a control mechanism receiving fluid flow data from the flow sensor and moving the first switch between the open position and the closed position upon selected fluid flow data and moving the second switch between the open position and the closed position upon selected fluid temperature data.

4. A fluid heating unit as claimed in claim 1 wherein the first switch is a first relay coupled between the first fluid heating tube and the power distributor, and the control mechanism is coupled to the first relay for actuating the first relay to control current flow from the power distributor to the first fluid heating tube and the second switch is a second relay coupled between the second fluid heating tube and the power distributor, and the control mechanism is coupled to the second relay for actuating the second relay to control current flow from the power distributor to the second fluid heating tube.

5. A fluid heating unit as claimed in claim 1 further including:

a thermal sensor coupled to the fluid heating tube assembly;

a flow sensor coupled to the fluid heating tube assembly; and a control mechanism receiving fluid flow data and fluid temperature data from the flow sensor and the thermal sensor, respectfully, moving the first switch between the open position and the closed position upon selected fluid flow and fluid temperature data, and moving the second switch between the open position and the closed position upon selected fluid flow and fluid temperature data.

6. A fluid heating unit as claimed in claim 5 wherein the control mechanism includes a thermal shut off switch coupled to the thermal sensor, and a pressure differential switch coupled to the flow sensor, the thermal shut off switch and pressure differential switch each being coupled to the first switch and the second switch.

7. A fluid heating unit as claimed in claim 1 wherein the resistive layer of the first fluid heating tube and the second fluid heating tube is formed in a spiral pattern about the tube.

8. A fluid heating unit as claimed in claim 1 further including piping coupled to the inlet end of the first fluid heating tube, a heat sink block carried by the piping, and the first switch and the second switch coupled to the heat sink block.

9. A fluid heating system comprising:

a fluid supply conduit;

a hot fluid conduit;

a fluid heating tube assembly including an inlet coupling coupled to the fluid supply conduit, an outlet coupling coupled to the hot fluid conduit, and a first fluid heating tube coupled to the inlet coupling and including a tube formed of heat conducting material, a dielectric coating permanently bonded on an outer surface of the tube, and a resistive layer formed on the dielectric coating, and a second fluid heating tube coupled between the first fluid heating tube and the outlet coupling, the second fluid heating tube including a tube formed of heat conducting material, a dielectric coating permanently bonded on an outer surface of the tube, and a resistive layer formed on the dielectric coating;

a power distributor coupled to the fluid heating tube assembly and coupleable to a power source;

a first switch coupled between the power distributor and the first fluid heating tube, the first switch movable between an open position preventing current flow to the first fluid heating tube and a closed position allowing current flow to the firstfluid heating tube; and a second switch coupled between the power distributor and the second fluid heating tube, the second switch movable between an open position preventing current flow to the second heating tube and a closed position allowing current flow to the second heating tube.

10. A fluid heating system as claimed in claim 9 further including:

a thermal sensor coupled to the fluid heating tube assembly; and a control mechanism receiving fluid temperature data from the thermal sensor and moving the first switch between the open position and the closed position upon selected fluid temperature data and moving the second switch between the open position and the closed position upon selected fluid temperature data.

11. A fluid heating system as claimed in claim 9 further including:

a flow sensor coupled to the fluid heating tube assembly; and a control mechanism receiving fluid flow data from the flow sensor and moving the first switch between the open position and the closed position upon selected fluid flow data and moving the second switch between the open position and the closed position upon selected fluid temperature data.

12. A fluid heating system as claimed in claim 9 wherein the first switch is a first relay coupled between the first fluid heating tube and the power distributor, and the control mechanism is coupled to the first relay for actuating the first relay to control current flow from the power distributor to the first fluid heating tube and the second switch is a second relay coupled between the second heating tube and the power distributor, and the control mechanism is coupled to the second relay for actuating the second relay to control current flow from the power distributor to the second fluid heating tube.

13. A fluid heating system as claimed in claim 9 further including:

a thermal sensor coupled to the fluid heating tube assembly;

a flow sensor coupled to the fluid heating tube assembly; and a control mechanism receiving fluid flow data and fluid temperature data from the flow sensor and the thermal sensor, respectfully, moving the first switch between the open position and the closed position upon selected fluid flow and fluid temperature data, and moving the second switch between the open position and the closed position upon selected fluid flow and fluid temperature data.

14. A fluid heating system as claimed in claim 13 wherein the control mechanism includes a thermal shut off switch coupled to the thermal sensor, and a pressure differential switch coupled to the flow sensor, the thermal shut off switch and pressure differential switch each being coupled to the first switch and the second switch.

15. A fluid heating system as claimed in claim 14 wherein the flow sensor includes a first pressure sensor mounted in the inlet coupling, and a second pressure sensor mounted in the outlet coupling, each coupled to the pressure differential switch.

16. A fluid heating system as claimed in claim 9 wherein the resistive layer of the first fluid heating tube and the second fluid heating tube is formed in a spiral pattern about the tube.

17. A fluid heating system as claimed in claim 9 further including piping coupled between the inlet coupling and the first fluid heating tube, a heat sink block carried by the piping, and the first switch and the second switch coupled to the heat sink block.

18. A fluid heating tube comprising:

a tube formed of heat conducting material having a first end, a second end, and a flow path extending therethrough;

a dielectric coating permanently bonded on an outer surface of the tube; and a resistive layer formed on the dielectric coating;

wherein the tube, dielectric coating, and resistive layer have generally equivalent thermal coefficients of expansion.

19. A fluid heating tube as claimed in claim 18 wherein the resistive layer is formed in a spiral pattern about the tube.

20. A fluid heating tube as claimed in claim 18 further comprising a first contact extending from the resistive layer and a second contact extending from the resistive layer.

21. A fluid heating tube as claimed in claim 18 further comprising:

a second tube formed of heat conducting material having a first end, a second end, and a flow path extending therethrough, one of the first end and the second end of the second tube coupled to one of the first end and the second end of the tube;

a dielectric coating permanently bonded on an outer surface of the second tube; and a resistive layer formed on the dielectric coating of the second tube;

wherein the second tube, dielectric coating, and resistive layer have generally equivalent thermal coefficients of expansion.

22. A fluid heating tube as claimed in claim 21 wherein the second tube is coupled to the tube by a curved tube element such as to place the second tube substantially parallel to the tube.

23. A fluid heating tube as claimed in claim 21 wherein the resistive layer of the second tube is formed in a spiral pattern about the second tube.

24. A fluid heating tube as claimed in claim 21 further comprising a first contact extending from the resistive layer of the second tube and a second contact extending from the resistive of the second tube.

* * * * *